US005694850A

United States Patent [19]

Pickard

[11] Patent Number: 5,694,850

[45] Date of Patent: Dec. 9, 1997

[54] COMPOSITE INK FOUNTAIN BLADE

[75] Inventor: John E. Pickard, Schertz, Tex.

[73] Assignee: Tech-Energy Co., Cibolo, Tex.

[21] Appl. No.: 657,684

[22] Filed: May 31, 1996

[51] Int. Cl.[6] ..... B41F 31/04; B41F 9/10

[52] U.S. Cl. ..... 101/365; 101/157; 101/169

[58] Field of Search ..... 101/365, 154, 101/157, 169

[56] References Cited

U.S. PATENT DOCUMENTS

| | | | |
|---|---|---|---|
| 2,161,943 | 6/1939 | Baue | 101/365 |
| 2,898,855 | 8/1959 | Richter | 101/365 |
| 3,236,178 | 2/1966 | Worthington et al. | 101/365 |
| 3,792,659 | 2/1974 | Albrecht | 101/365 |
| 3,986,453 | 10/1976 | Boose | 101/169 |
| 4,624,183 | 11/1986 | Kunkel et al. | 101/365 |
| 4,895,071 | 1/1990 | Benton | 101/169 |

*Primary Examiner*—Edgar S. Burr
*Assistant Examiner*—Amanda B. Sandusky
*Attorney, Agent, or Firm*—Gunn, Lee & Miller

[57] ABSTRACT

A composite ink fountain blade for a printing press wherein the blade has a multiplicity of blade segments fixed between an upper cleaning plate and a lower support bar. Each of the segments is provided with smooth, ground or polished, machine finished, straight and parallel sides for sliding abutment against each other during the adjustment of an extending portion of the blade segments. Adjustment of the blade segments controls the flow of ink from the ink reservoir through the ink fountain blade first pickup roller nip.

1 Claim, 4 Drawing Sheets

COMPOSITE INK FOUNTAIN BLADE

BACKGROUND OF THE INVENTION

The present invention relates to printing presses, and more particularly to newsprint presses having an extended knife blade or fountain blade for controlling the deposition of ink onto a first pickup roller (the ink fountain roller) with eventual distribution to other rollers in the press.

In the process of printing, ink must be deposited upon rollers for application to the printing plates. More specifically, in offset printing, inked plates impress upon rubber blankets and transfer the ink to the blankets and then to the paper. The control of the flow of ink to these rollers is critical to provide a constant deposition of the ink which matches the ink density required by the print image or the printing plate. If too much ink is transferred to the rollers then too much ink will be applied to the plates and blankets resulting in a blurred print transfer to the paper. If too little ink is transferred to the rollers, insufficient ink may be applied to the plates and blankets resulting in a faint print transfer to the paper.

The purpose of the present invention is to allow the press operator to carefully control the flow of ink to the first pickup roller by fine adjustment of the gap or nip between the ink fountain blade and the first pickup roller. As will be discussed below, minute adjustments of the gap are capable because the ink fountain blade of the present invention is a composite blade having a multiplicity of individual blade segments, each adjustable without effecting adjacent segments. This fine control of the gap is achievable across the entire width of the fountain blade/pickup roller nip.

Previous presses have used a continuous length of blade, and, as a result, adjustment of the gap at the blade/pickup roller nip at one location caused the adjacent position of the blade to bow and distort resulting in a change of the gap previously set for the adjacent portion of the blade. Such ink fountain blades had to be continuously adjusted during a press run to achieve uniform ink flow from the ink fountain. Thus, ink flow adjustments at the pickup nip were very time consuming and inaccurate. Readjustment resulted in significant product loss and excessive equipment downtime.

Attempts to improve flow control have included cutting the fountain blade along its leading edge to separate the blade into smaller sections for finer adjustment. While this change resulted in finer control of the gap, such sectionalized blades leaked ink between the blade sections because of the removal of material in the process of sectionalizing the blade. Despite efforts to remove less material through finer cutting processes, these sectionalized blades continued to develop leaks.

The present invention solves the long-standing problems noted above with existing ink fountain blades by providing a composite blade wherein individual segments are machined along the outer sides to ensure a tight, abutting precision fit with adjacent, parallel segments eliminating leakage between the segment while allowing the segments to be individually adjusted. The segments are sandwiched between a lower blade support bar and an upper cover plate with the leading end of each segment extending beyond the leading edges of the support bar and cleaning plate. These individual leading ends are capable of flexing by operation upwardly and downwardly of adjustment keys or eccentric levers to open or close the gap between the pickup roller and the ink fountain blade without disturbing an adjacent segment or opening a space between the segments through which ink may leak.

SUMMARY OF THE INVENTION

The present invention provides a composite ink fountain blade for printing presses with individual blade segments securely affixed between an upper cover plate and a lower blade support bar. A leading end of the blade segments extends beyond the leading edges of the cover plate and the blade support bar to allow for flexible adjustment of the gap between the blade and the first ink pick-up roller. The sides of each of the blade segments is provided with a smooth ground or polished machine finish which enables the parallel segments to be abutted against each other yet able to slide against each other during flexing of the segment. Preferably, no gap or space is formed between the abutting surfaces, thereby eliminating any leakage of ink between the segments. It has been found that any gap must be no greater than 0.0002".

BRIEF DESCRIPTION OF THE DRAWINGS

The invention will be better understood and objects other than those set forth above will become apparent when consideration is given to the following detailed description of the preferred embodiments. Such description makes reference to the annexed drawings wherein.

DETAILED DESCRIPTION OF THE PREFERRED EMBODIMENT

Figure 1:
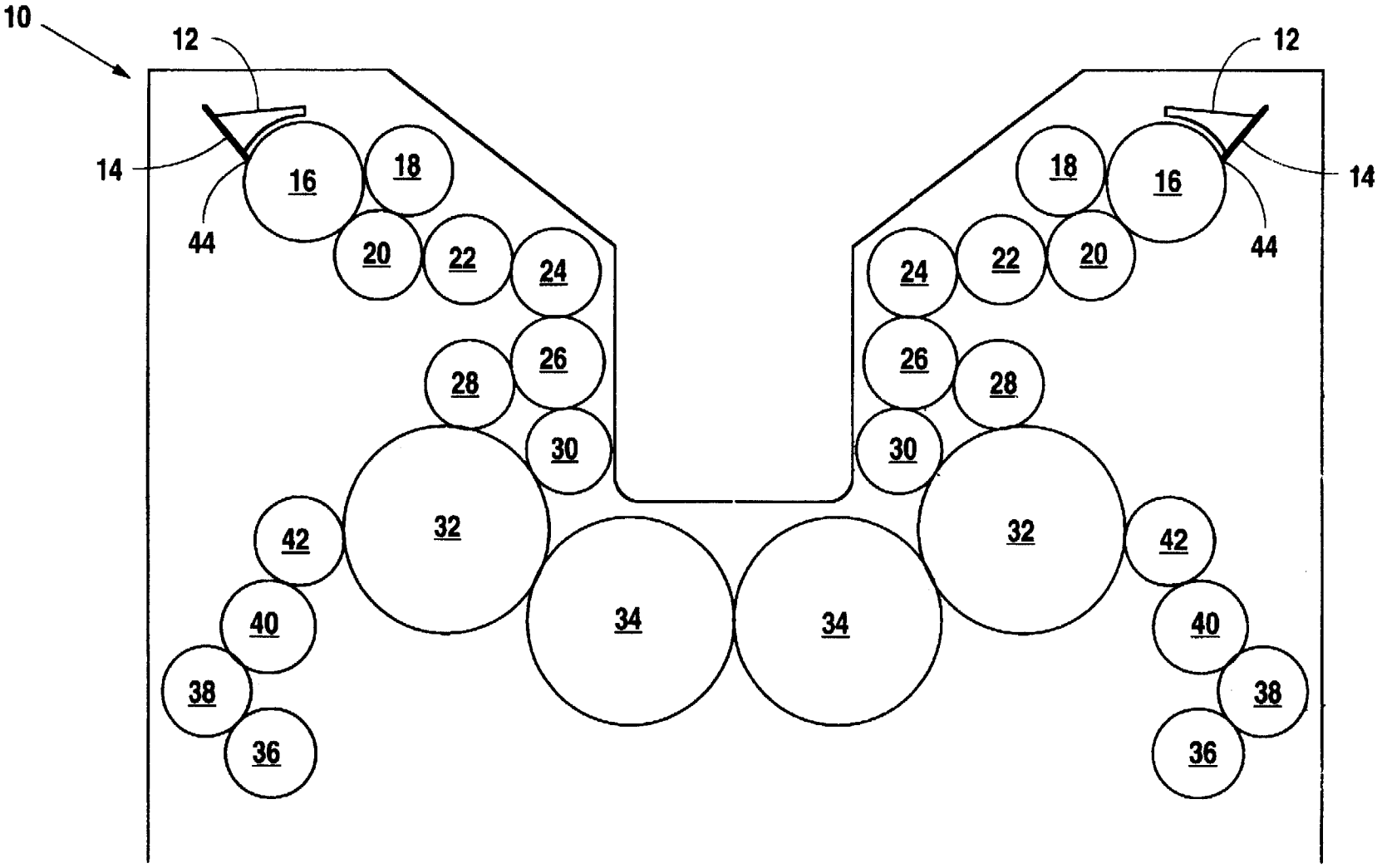
FIG. 1 is a schematic illustration of an ink fountain assembly, an ink fountain blade, ink rollers, and dampener rollers of a printing press.

FIG. 1 is a schematic illustration of the arrangement of an ink fountain assembly, an ink fountain blade, ink rollers and dampener rollers of a printing press. This is well known in the art except for the composite blade 14. The press 10 is shown housing the ink fountain assembly 12, the ink fountain blade 14, and the first pickup roller 16 (also called the ink fountain roller). Additional rollers shown in FIG. 1 are ink feed roller 18, ink transfer roller 20, auxiliary ink drum 22, second ink transfer roller 24, main ink drum 26, first ink form roller 28, second ink form roller 30, plate 32, blanket 34, dampener fountain roller 36, dampener feed roller 38, dampener vibrator drum 40, and dampener form roller 42.

The gap 44 between the ink fountain blade 14 and the ink fountain roller 16, controls the flow of ink from the ink fountain assembly 12 to the ink fountain roller 16 and ultimately through the entire roller series shown in FIG. 1. The ink fountain assembly 12 forms an ink reservoir for holding a quantity of ink to be utilized in the printing process.

Figure 2:
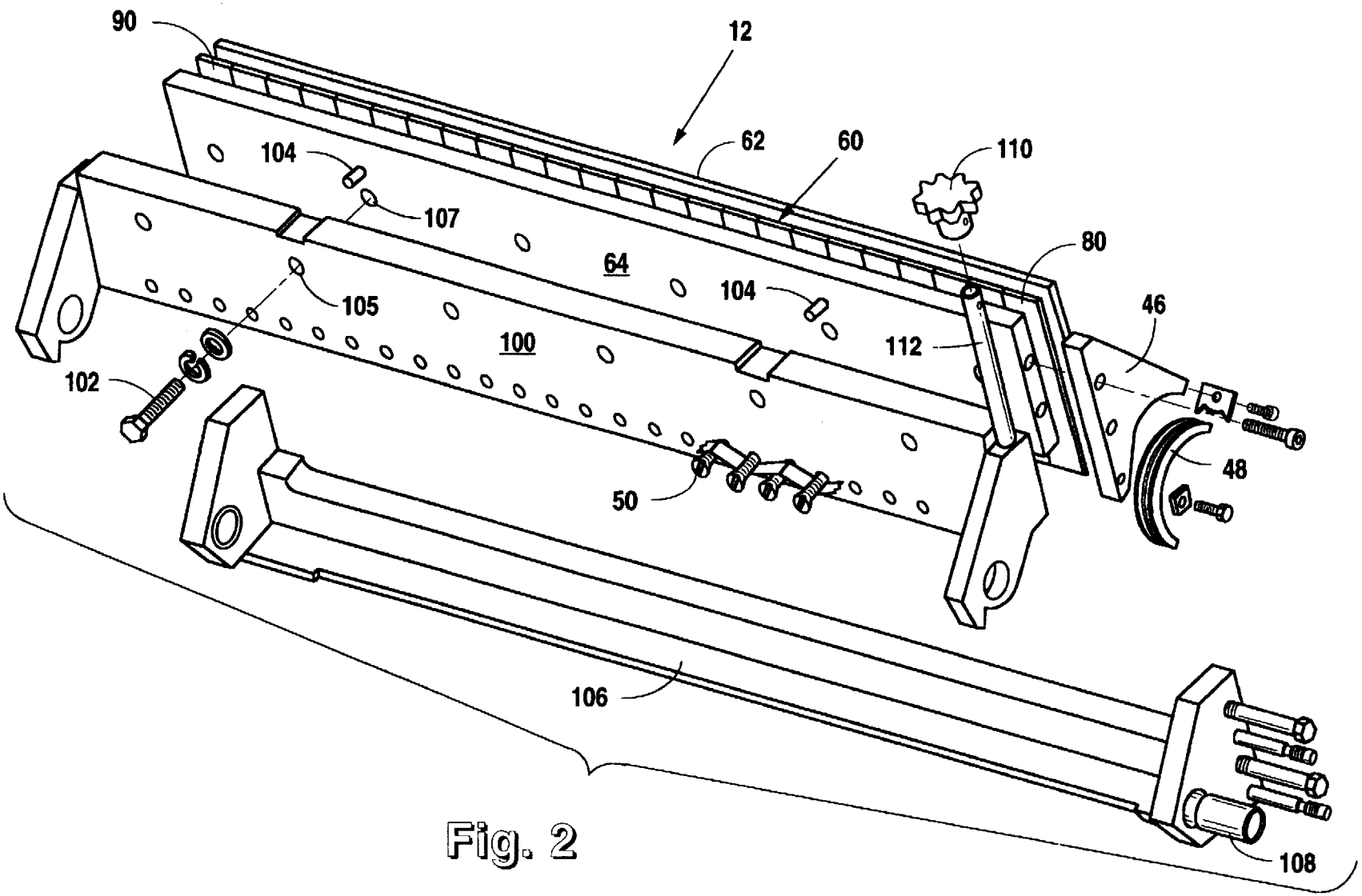
FIG. 2 is an exploded perspective view of an ink fountain assembly, with key-type blade adjustment, housing the composite ink fountain blade of the present invention.

FIG. 2 illustrates in more detail an ink fountain assembly 12 in an exploded view. Fountain end member 46 and fountain seal 48 fit closely to the side end of the first pickup roller 16 (not shown in FIG. 2) to form the ink reservoir between the roller 16 and the ink fountain blade 14, as is well known in the art.

The distance between the ink fountain blade's lead end and the roller 16 may be adjusted by turning ink key 50 to urge the end of the key up against the bottom surface 70 of the lead end 72 of the individual key segments 60. This in turn urges the lead end 72 closer to the surface of the first pickup roller 16.

Turning momentarily to FIGS. 4–7, the construction of the ink fountain blade 14 of the present invention may be seen. A multiplicity of individual blade segments 60 are sandwiched between upper cover plate 62 and lower blade support bar 64 to form the composite ink fountain blade In one embodiment of the present invention, the blade support bar 64 is of steel composition approximately 4½" long, approximately ⅝" thick, and approximately 35" in width. The size of bar 64 varies depending on the specific size of the printing press. This same embodiment includes a cover plate 62 of steel composition approximately 4½" long, approximately 0.010" thick, and approximately 35" in width. The embodiment incorporates twenty-four blade segments 60 made of hardened spring steel composition, each approximately 5¾" long, 0.060" thick, and 1¼" wide. The number of blade segments and width of each segment is determined by the number of ink key adjusters on the particular press.

To construct the composite ink fountain blade 14 of the present invention, blade support bar 64 is provided with a smooth top surface 66 upon which the individual blade segments 60 are affixed by an adhesive. Alternatively, the segments may be affixed by use of mechanical screws or other appropriate fastening means. Each segment 60 has a top surface 68, a bottom surface 70, a leading end 72, a trailing end 74, a first side 76, and a second side 78. Sides 76 and 78 are straight and provided with smooth ground or polished machine finishes to ensure that when abutted to an adjacent segment there is no gap greater than 0.0002" and the segments may slide against each other without hanging up. Each segment 60 is rectangular with straight parallel sides 76 and 78 of equal length.

A portion of the bottom surface. 70 of first segment 80 is pressed onto the adhesive which has been applied to top surface 66 of bar 64 with a portion of the leading end 72 extending beyond the leading edge 86 of bar 64. In the embodiment discussed approximately 1¼" of the segment 80 extends beyond the leading edge 86 of bar 64. This extending portion is capable of flexing when urged by an ink key 50.

The first side 76 of the first segment 80 is set in parallel alignment with the first end 82 of support bar 64 to form a straight side for abutment against the ink fountain end member 46 and ink seal 48 when the press is assembled.

Figure 4:
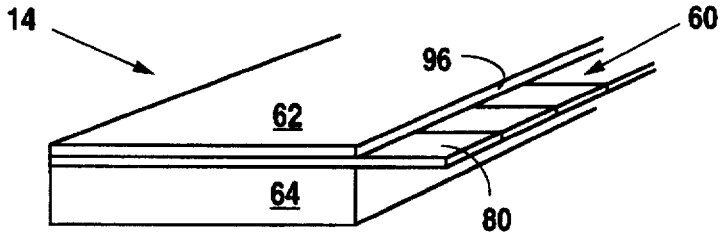
FIG. 4 is a perspective view of the composite ink fountain blade of the present invention.
Figure 5:
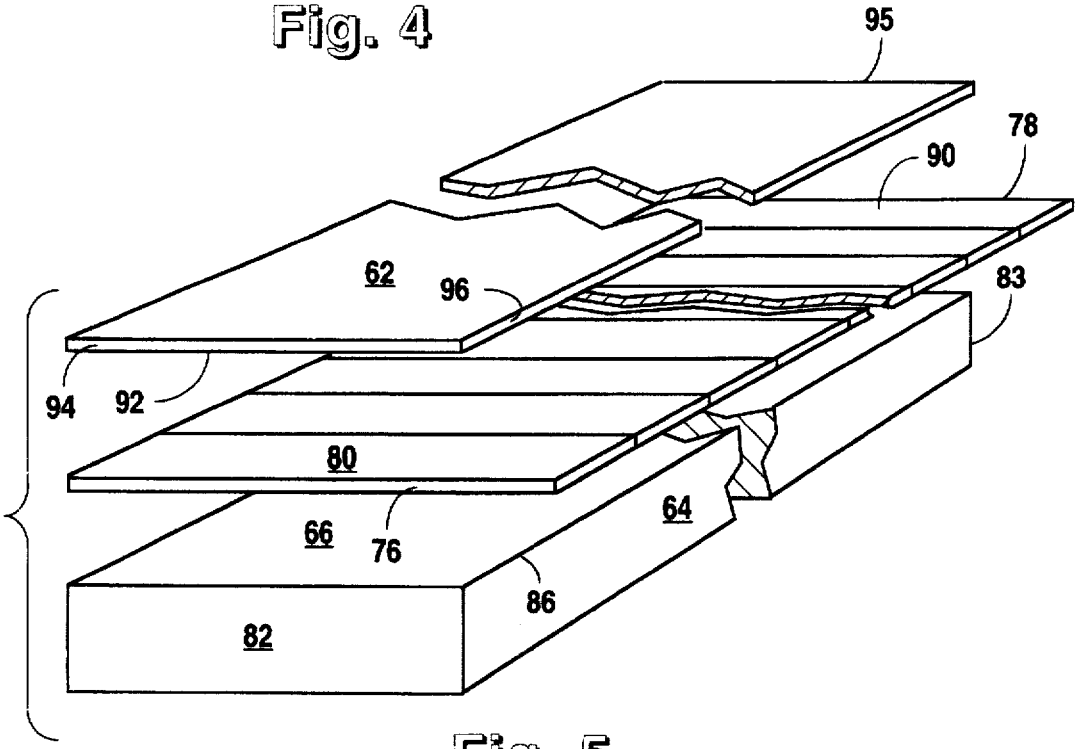
FIG. 5 is an exploded perspective view of the composite ink fountain blade of the present invention.
Figure 6:
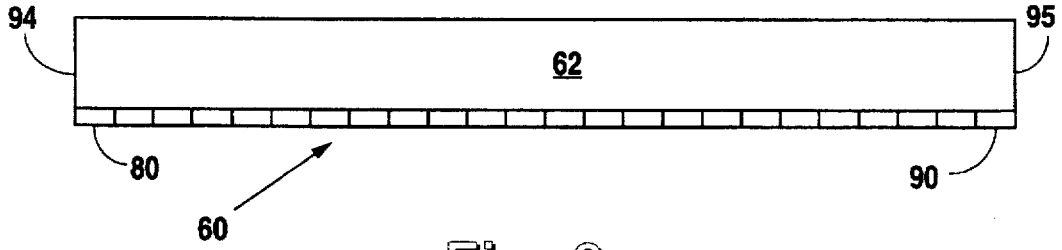
FIG. 6 is a top view of the composite ink fountain blade of the present invention.
Figure 7:
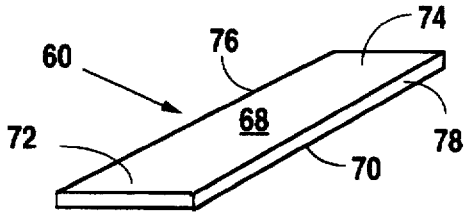
FIG. 7 is a perspective view of one of the blade segments of the present invention.

The remainder of the blade segments 60 are attached to the support bar 64 with the first side 76 abutted against the second side 78 of the adjacent segment as shown in FIGS. 4–6. Each blade segment 60 extends the same distance from the leading edge 86 of bar 64. It is important to ensure that there is no space or gap greater than 0.0002" between the segments 60.

The last blade segment 90 is attached to the support bar 64 with the second side 78 set in parallel alignment with the second end 83 of support bar 64 to form a straight side for abutment against the opposite ink fountain end 46 and ink seal 48 when this part is assembled in the press.

After all of the blade segments 60 have been affixed to the support bar 64, the cover plate 62 is affixed by adhesive, mechanical screws or other appropriate fasteners along a bottom surface 92 to a portion of the top surface 68 of the blade segments 60. A first end 94 of the cover plate 62 is aligned with the first end 82 of the support bar 64 and a second end 95 is aligned with the second end 83 of the support bar 64. Again, this ensures a proper seal of the composite blade 14 within the ink fountain assembly 12 and against the first pickup roller 16. As with the support bar 64, the leading ends of the blade segments extend beyond the leading edge 96 of the cover plate 62 approximately 1¼". Thus, a composite ink fountain blade 14 may be constructed.

The ink fountain blade 14 (made up of blade support bar segments 60, and cover plate 62) is removably affixed to the ink fountain assembly 12 as shown in FIG. 2. The composite blade 14 is fastened to the assembly body 100 by fasteners 102 passing through threaded mounting holes 105 in the body 100 and threaded holes 107 in the support bar 64 with the assistance of alignment pins 104. In turn the body 100 is mounted on mounting bracket 106 which attaches assembly 12 to the press 10. As is well known in the art, assembly 12 may be pivoted about bracket 106 and pivot pins 108 to facilitate ink loading and cleaning. Knob 110 and lockup bolt 112 secure the body 100 in position on the bracket 106.

FIG. 2 further illustrates ink keys 50 which control the gap between the leading ends 72 of segments 60 from the pickup roller 16. Keys 50 may be turned to move the body of the key inwardly against the bottom side 70 of the segments 60. The segments have been sandwiched between bar 64 and plate 62 such that when the blade 14 is attached to the press 10, keys 50 contact a midpoint between the first side 76 and the second side 78 of the blade segment 60. This ensures best control of segment flexing.

Figure 3:
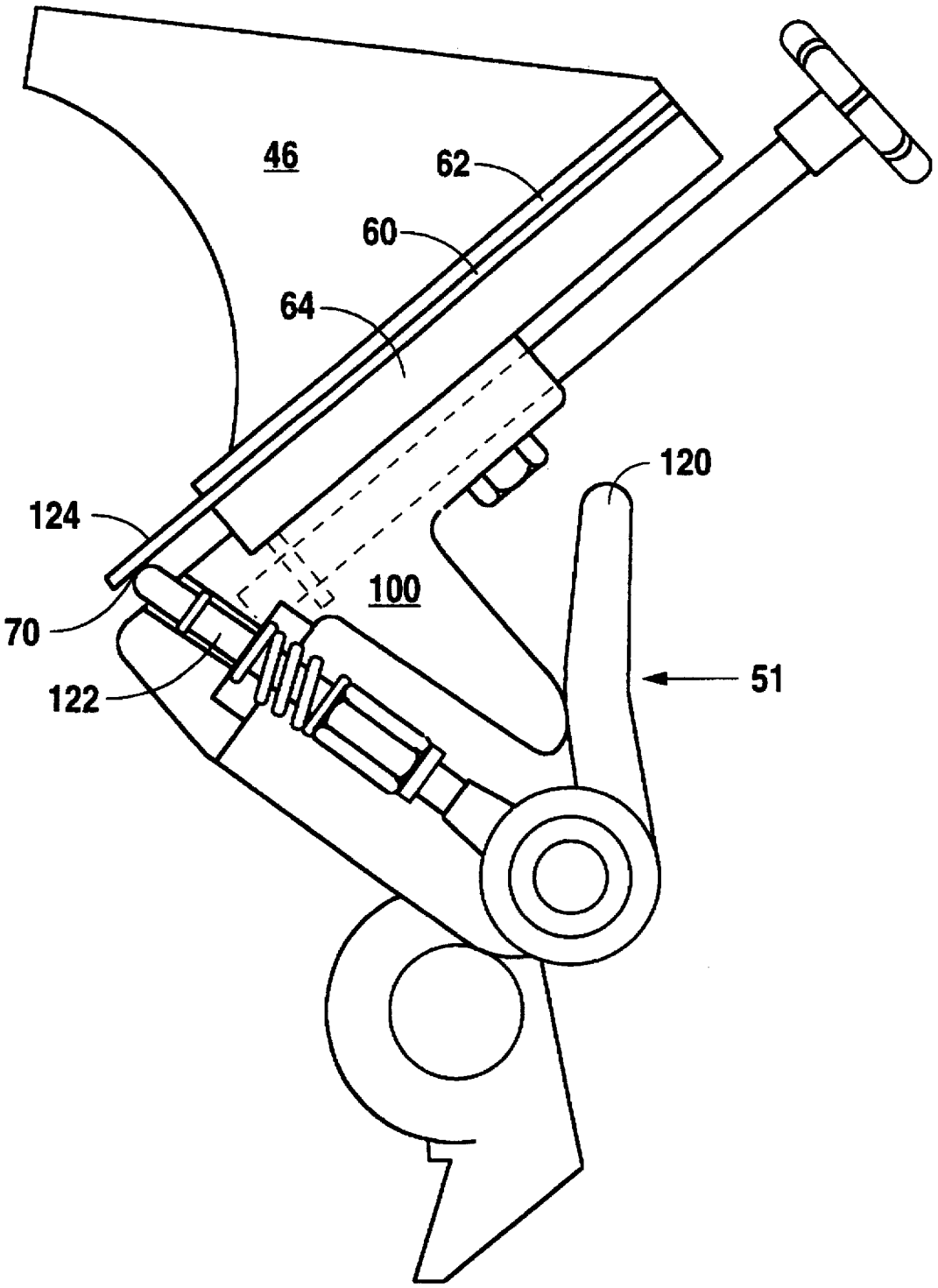
FIG. 3 is a side view of an ink fountain assembly, with lever-type blade adjustment, housing the composite ink fountain blade of the present invention.

FIG. 3 illustrates a side view of a fountain assembly 12 where the keys 50 have been replaced by lever type adjusters 51. Movement of eccentric lever 120 results in movement of ink level shaft 122 against the bottom surface 70 of the extending portion 124 of the blade segment 60 which in turn adjusts the gap 44 between the leading end 72 of blade segments 60 and the pickup roller 16.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. A composite ink fountain blade comprising:

a blade support bar having a first end, a second end, a top surface and a leading edge;

a multiplicity of blade segments, each of said segments having a top surface, a bottom surface, a leading end, a trailing end, a first side and a second side, each of said multiplicity of segments affixed along a portion of said bottom surface of each of said multiplicity of segments to said top surface of said support blade with a portion of said leading end of each of said multiplicity of blade segments extending beyond said leading edge of said support bar no more than approximately 1¼";

a first of said multiplicity of said blade segments approximately 0.060" thick affixed to said support bar with said first side aligned with said first end of said support bar;

a last of said multiplicity of said blade segments affixed to said support bar with said second side aligned with said second end of said support bar;

a remainder of said multiplicity of said blade segments positioned between said first segment and said last segment and affixed to said support bar with each of said first sides abutting against each of said second sides of adjacent blade segments with no more than approximately 0.0002" between said first and second sides of said adjacent segments; and a cover plate having a first end, a second end, a bottom surface and a leading edge, said cover plate affixed along said bottom surface to said top surface of each of said multiplicity of blade segments, said first end of said plate aligned with said first end of said support bar, said second end of said plate aligned with said second end of said support bar, and said leading edge of said plate aligned with said leading edge of said support bar with said portion of said leading end of each of said multiplicity of blade segments extending beyond said leading edge of said cover plate and said support bar.

* * * * *